US006263825B1

(12) United States Patent
Davidson

(10) Patent No.: US 6,263,825 B1
(45) Date of Patent: Jul. 24, 2001

(54) BOAT WITH CONVERTIBLE REAR CABIN AREA

(75) Inventor: Samuel L. Davidson, Monroe, LA (US)

(73) Assignee: Duracraft Marine Corporation, Delphi, LA (US)

( * ) Notice: Subject to any disclaimer, the term of this patent is extended or adjusted under 35 U.S.C. 154(b) by 0 days.

(21) Appl. No.: 09/241,055

(22) Filed: Feb. 1, 1999

(51) Int. Cl.[7] ..... B63B 8/00
(52) U.S. Cl. ..... 114/343; 114/363
(58) Field of Search ..... 114/343, 363, 114/361, 364

(56) References Cited

U.S. PATENT DOCUMENTS

| | | | | |
|---|---|---|---|---|
| 3,475,773 | * | 11/1969 | Codman, Jr. | 114/363 |
| 3,823,431 | * | 7/1974 | Miller | 114/361 |
| 4,738,217 | * | 4/1988 | Smith | 114/363 |
| 4,854,261 | * | 8/1989 | Goldsmith | 114/363 |
| 5,136,963 | * | 8/1992 | Zuzik | 114/363 |
| 5,331,917 | * | 7/1994 | Magers | 114/361 |
| 5,497,724 | * | 3/1996 | Brown et al. | 114/363 |
| 5,706,752 | * | 1/1998 | Menne, Jr. et al. | 114/361 |

OTHER PUBLICATIONS

Dura Craft Value Engineered for a Lifetime (brochure) 1998, p. 4 "Funtastic" Boat.

* cited by examiner

*Primary Examiner*—Ed Swinehart
(74) *Attorney, Agent, or Firm*—Jacobson, Price, Holman & Stern, PLLC

(57) ABSTRACT

A boat including a hull with a cockpit section, and a rear cabin section normally concealed by a horizontally extending cushioned deck element located adjacent the stern. The deck element is hinged along its rear edge so as to be elevatable to expose a sunken floor wherein sink and toilet facilities may be provided. An enclosure for the rear cabin area may be deployed to provide privacy for changing clothes or using the toilet. In combination with the sunken floor, the height of the enclosure permits a person to stand erect and move about freely. A portable toilet may be stored under a captain's chair immediately in front of the rear cabin area and slid rearwardly for use in the rear cabin area as needed.

14 Claims, 7 Drawing Sheets

BOAT WITH CONVERTIBLE REAR CABIN AREA

FIELD OF THE INVENTION

The present invention relates to boats powered by outboard or so called "I/O" engines. The invention provides for a multi-purpose cabin adjacent the stern of the boat, which cabin is covered by a cushioned deck immediately over and extending forwardly of the engine, with at least part of the cushioned deck hinged so that when the hinged part is raised upwardly, the cabin is readily accessible to adults thereby providing utility space for privacy, for a sink, for cutting boards, for a refrigerator, for a toilet, and/or other such amenities.

BACKGROUND OF THE INVENTION

Cruisers and yachts, usually more than 30' in length, commonly have toilet facilities with "stand-up" entry as well as separate kitchen and sleeping areas. Even some smaller runabouts have underdeck sleeping areas, toilet facilities and kitchens, and some pontoon and deck boats have "fold-up" dressing rooms and even above deck cabin areas. However, there remained a need for a design that provided "convertible space" for "stand-up" kitchen and toilet facilities, as well as adequate cushioned deck for sleeping or sunbathing. The object of this invention is to satisfy that need.

SUMMARY OF THE INVENTION

It is therefore a primary object of the instant inventive concepts to provide a boat having a cushioned deck or the like over an area adjacent the stern, which area is readily converted to an enlarged rear cabin having sink and toilet facilities and being selectively enclosable for privacy in use.

Another object of this invention is to provide a boat having a canopy and a rear sunbathing deck, covering a cabin area convertible to an enclosable dressing area of sufficient height to permit a user to stand fully erect and move about comfortably.

A further object of this invention is the provision of a boat having an area covered by a cushioned deck, normally hidden from view which contains a sink for food preparation and the like, a hidden portable toilet, and a surroundable enclosure to selectively conceal occupants of the area during use.

Consistent with the foregoing objects, this invention provides a boat with a seating cockpit toward the front, a driving area to one side of the cockpit containing a captain's seat and equipment to operate the boat, and a cushioned deck extending across the rear of the boat between the stern and cockpit. The deck is normally horizontal in use, positioned above the boat engine, and incorporates a hinged portion to expose an enclosed area with a sunken floor to provide increased height to a fully enclosable rear cabin area.

On one side of the rear cabin area, normally hidden by the cushioned deck, a sink and food preparation area may be provided. Compartments are provided on either side of the engine area for storage of ice chests, food, serving implements, clothing or the like, and are accessible from the rear cabin area when the hinged portion of the cushioned deck has been raised.

The side of the rear cabin area immediately behind the captain's seat accommodates a portable potty which may be concealed beneath the captain's seat and slid rearwardly into the enclosable cabin area when desired.

In order to provide privacy to the rear cabin area for changing clothes or use of the toilet facilities, a canopy with closable sides may be provided of a height sufficient, in combination with the sunken rear cabin floor, for a normal person to stand fully erect and move freely therewithin. The sides of the enclosure may include transparent windows with rolled up opaque curtains to provide complete privacy to the rear cabin area. Alternatively, an enclosure may be hung on the canopy support rods, with vertically extending closable openings for access and ventilation. In either event, the rear cabin area can be provided with complete privacy for use of the toilet facilities or changing clothes. Additionally, with the cushioned deck horizontal and the enclosure in place, the rear cabin area is suited to sleeping.

The rear cabin area below the cushioned deck may be separated from the forward section by a sliding panel which may be removed when the deck is lifted to provide a passageway. The panel may be replaced to lock the area.

Immediately adjacent the transom of the boat, if adapted to be driven by an outboard engine, is a storage area for batteries, rigging access and the like, and on either side of this area are enclosed pods filled with flotation material. These pods are covered by decking, and provide the areas thereabove for storage accessible from the rear cabin area.

These and other objects of the invention, as well as many of the intended advantages thereof, will become more readily apparent when reference is made to the following description taken in conjunction with the accompanying drawings wherein similar reference characters refer to similar parts in the different embodiments.

DETAILED DESCRIPTION OF THE PREFERRED EMBODIMENTS

Figure 1:
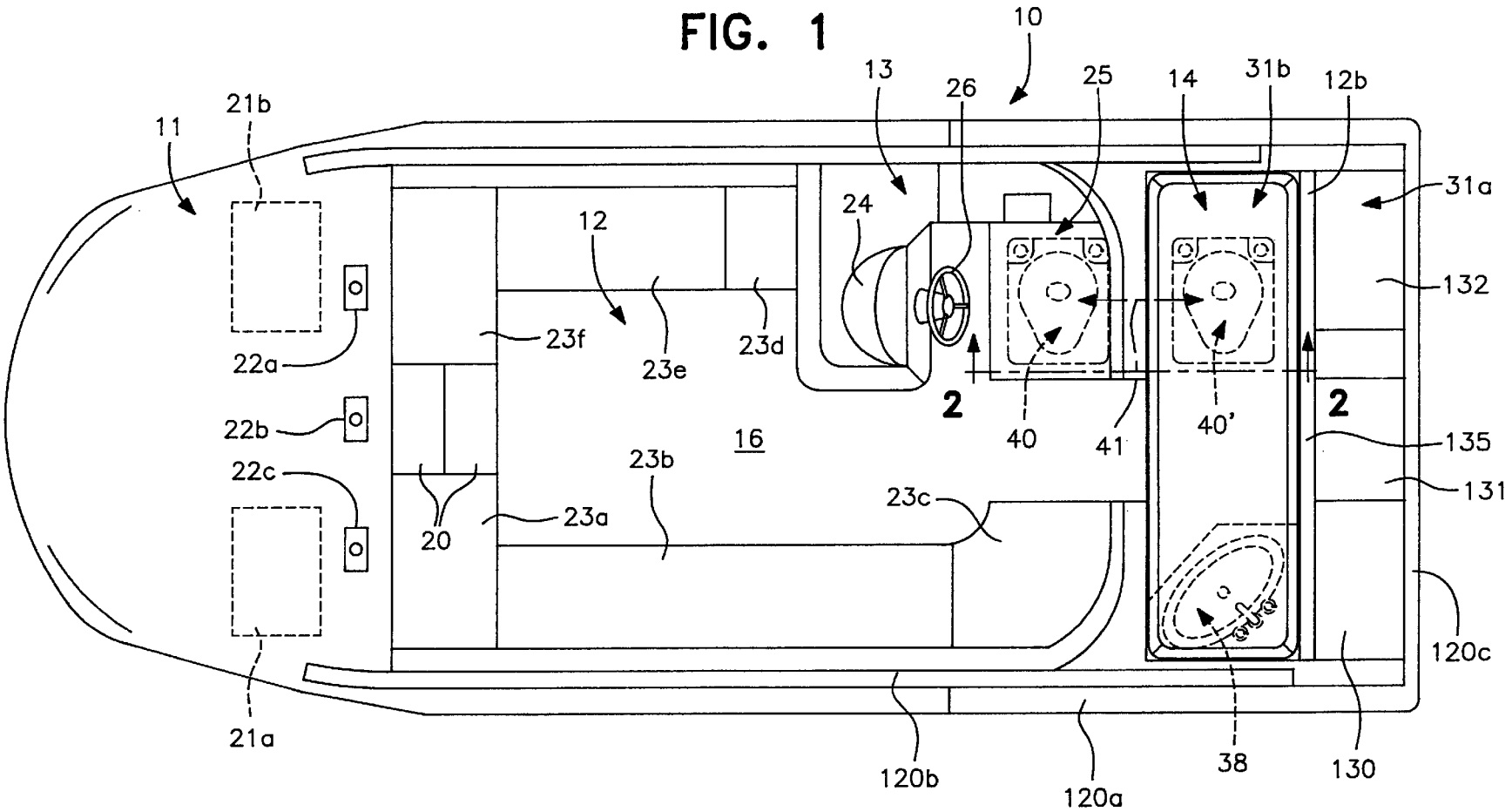
FIG. 1 is a plan view of one embodiment of a boat according to the present invention illustrating a forward seating cockpit and front fishing deck, a driving area to one side of the cockpit, and a rear cabin area normally covered by a horizontally oriented cushioned deck, with a sink and movable toilet facilities being shown in dotted lines thereunder.
Figure 2:
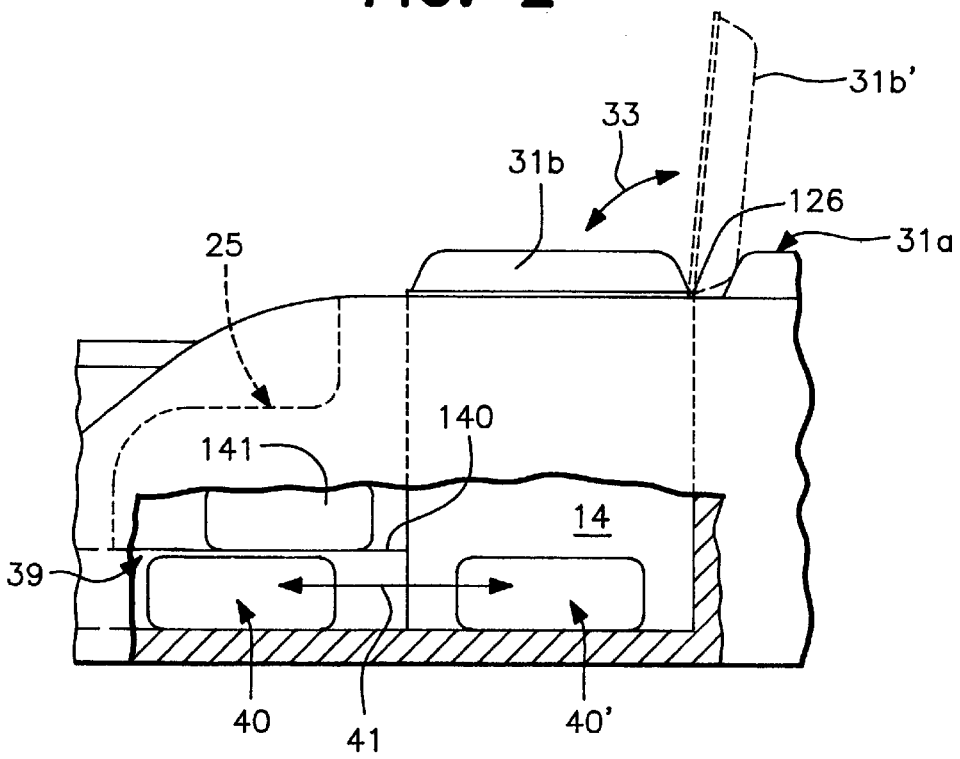
FIG. 2 is a fragmentary sectional view taken along lines 2—2 of FIG. 1 illustrating an enlarged portion of the rear cabin area and a storage area under the captain's seat showing the manner in which a step may be stored under the captain's seat to be slid sideways to facilitate accessing the cushioned deck, with a portable toilet stored in a sunken floor area beneath the captain's seat to be slid into the rear cabin area for use, a portion of the cushioned deck being shown in its raised position in dotted lines.

In describing the preferred embodiments of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

With reference to the drawings in general, and to FIGS. 1–9, in particular, one embodiment of a boat embodying the teachings of the instant invention is generally designated as 10. The hull may be formed of any suitable material such as aluminum or fiberglass.

Generally, the boat 10 can be divided into three areas, a raised forward deck 11, a central cockpit area 12, and a rear cabin area 14. Within the cockpit area is a driver's section 13.

Figure 4:
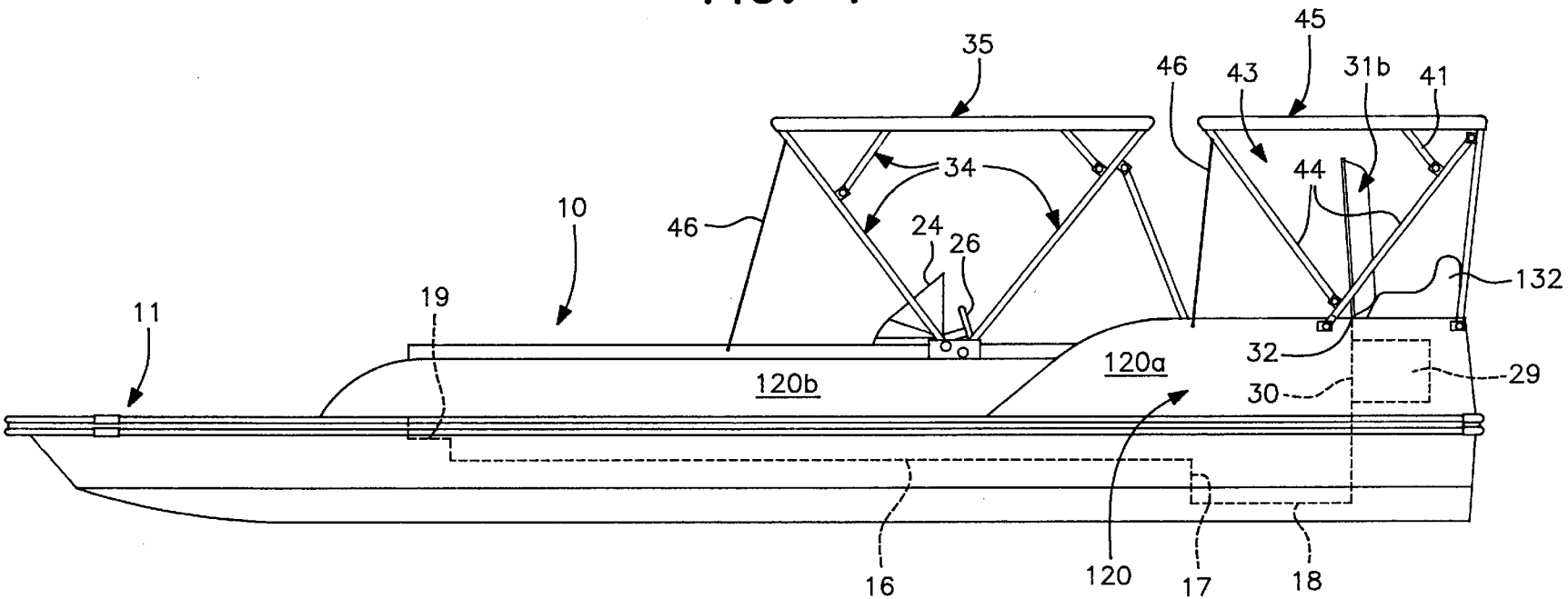
FIG. 4 is a view similar to FIG. 3 with the cushioned deck lifted and showing the canopy supports fully extended.

As best shown in FIG. 4, the boat 10 includes a floor 16 with a step 17 leading down to a sunken section 18 in the rear cabin area 14 and steps 19 leading up to the forward deck 11.

Referring now to FIG. 1, the forward deck 11 may include concealed storage areas 21*a* and 21*b* and pedestal bases 22*a*, 22*b* and 22*c* for anchoring fishing seats (not shown) in a well known manner. A plurality of cushioned seats 23*a*, 23*b*, 23*c*, 23*d*, 23*e* and 23*f* are provided to form cockpit seating in the central area 12, with storage areas (not shown) beneath the seats, if desired.

The driver's section 13, in its preferred embodiment, includes a windscreen 24, a captain's or operator's seat 25, a steering mechanism 26 and other conventional operating controls (not shown).

Figure 8:
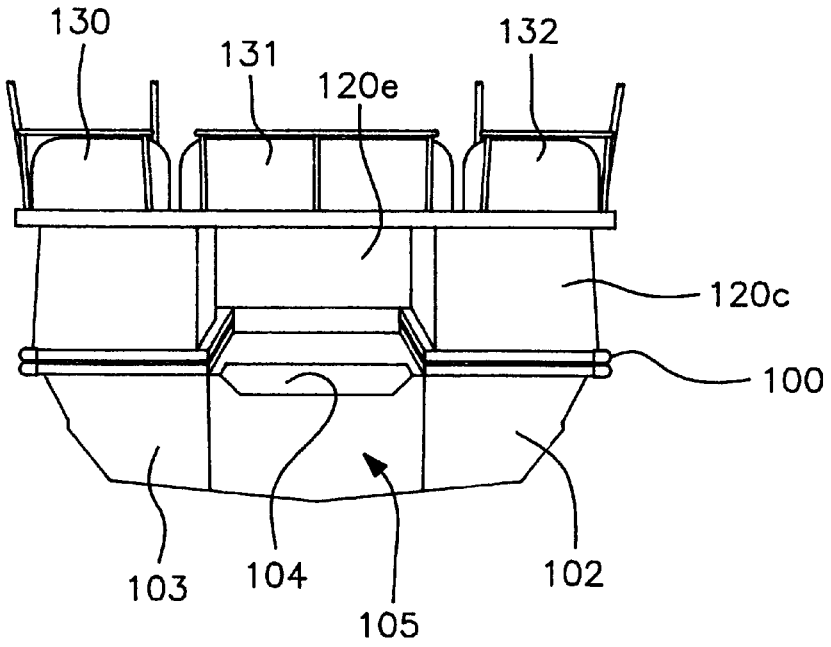
FIG. 8 is a rear view of the transom area of a boat consistent with the preferred embodiment.
Figure 9:
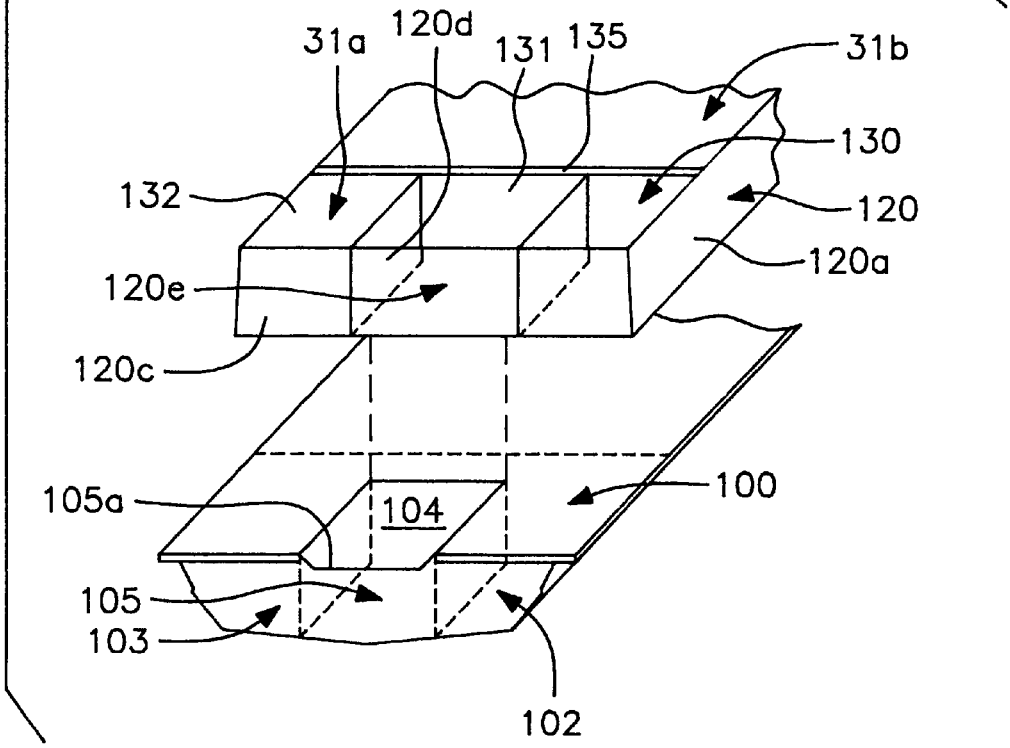
FIG. 9 is an exploded view of the rear portion of the boat of FIG. 1 illustrating the details thereof.

At the stern of the boat, as shown in FIGS. 8 and 9, on the port and starboard sides are enclosed pods 102 and 103 filled with flotation material. In the preferred embodiment, between the pods is a storage area 104 for batteries, oil reservoir, etc. In this embodiment, the boat is adapted to be powered by an outboard engine (not shown). Alternatively, an inboard engine (not shown) can be located in the storage area, with an outboard drive (also not shown) extending rearwardly of the transom 105.

Above the pods 102, 103 and storage area 104 is the rear horizontal deck 100. The rear deck covers the pods and extends around the rear underdeck storage compartment. Peripherally around the rear deck 100 and extending thereabove are cabin walls 120 having side portions 120*a*, 120*b*, rear portions 120*c* and rear central portions 120*d* defining an open central area 120*e* over the storage area 104 adapted to receive the engine (not shown) when it is lifted about the recessed top 105*a* of the transom 105 to an inoperative position in a well known manner. These walls define the rear cabin area 14 with an opening 36 between the forward sections of these walls defining the entryway to the cabin. See FIG. 5. The cabin walls 120 therefore enclose the area over the pods 102 and 103 and the area above the sunken floor 18.

On top of the walls 120 is a cushioned deck 31. The rear section 31*a* of this cushioned deck extends immediately over the storage area and in turn over the motor as well as over the pods. The forward section 31*b* of this cushioned deck 31 extends over the remaining area defined by the cabin walls 120, namely the area of the cabin above the sunken floor 18. The rear section 31*a* of the cushioned deck is preferably formed of three sections 130, 131 and 132, two of which, 130 and 132, are over the pods 102, 103, respectively, and one of which 131 is over the engine and preferably hinged at 135 to provide access to the engine.

Figure 5:
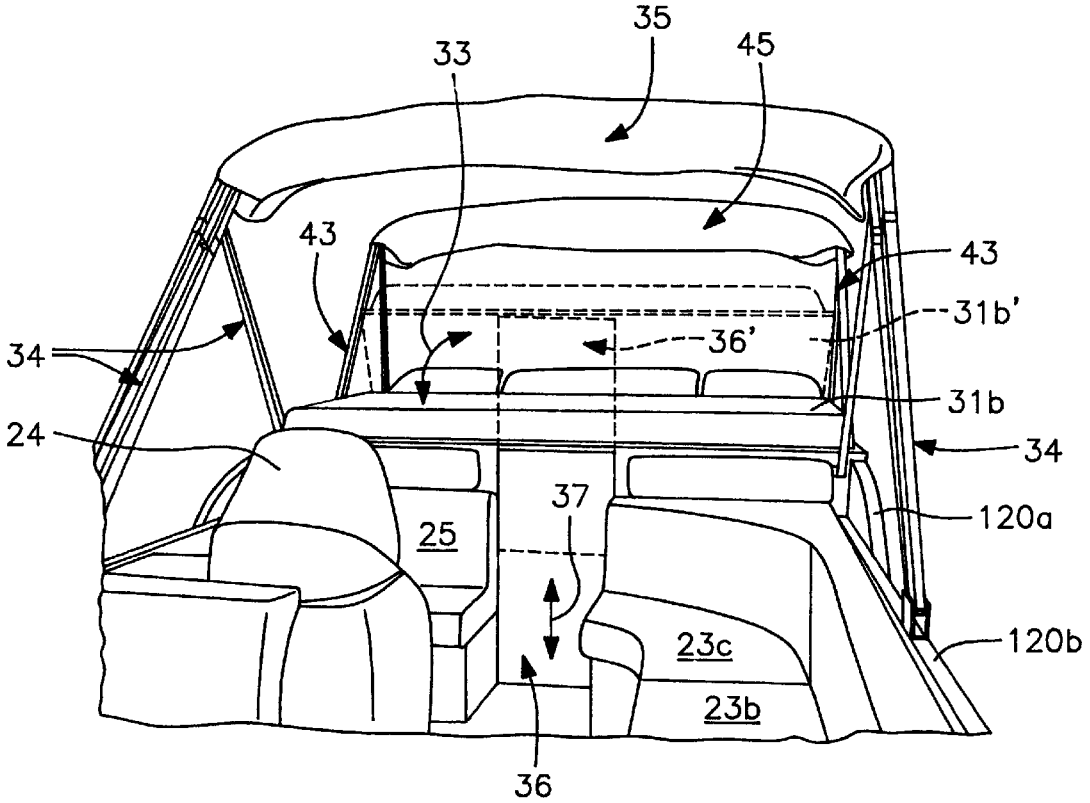
FIG. 5 is a perspective view of the rear part of the boat of FIG. 1 with the canopies retracted to "radar arch" position, the upward sliding of a panel to provide limited access to the rear cabin area being shown in dotted lines.

The forward section 31*b* of the cushioned rear deck 31 is hinged along its rear edge at 126 where it joins the rear section 31*a* of the cushioned deck for pivotable movement in the direction of the arrows 33 in FIG. 5 between a generally horizontal orientation shown in solid lines and a generally vertical orientation shown in dotted lines at 31*b'*.

The side walls 120*a*, 120*b* which define the side of the cockpit area 12 support the backs of the cockpit seats along the cockpit sides, and also provide support for the driver's console at 13.

Secured to the top of the sides 120*b* is the frame 34 of the canopy top 35 for the cockpit. Secured to the sides 120*a* of the walls 120 of the cabin area is the frame 44 of the rear cabin canopy top 45.

The canopy 35 can be selectively positioned over the cockpit to provide protection against sun and rain, if desired. The support mechanism 34 is shown as folded or collapsed in FIGS. 3 and 5 and fully deployed in FIGS. 4, 6 and 7.

The configuration of the boat to provide wrap-around cockpit seating in full view of the operator, as well as the specific adaptation to fishing and storage areas is important but not an essential part of the instant inventive concepts. While the particular construction shown in FIGS. 1–9 is desirable, those skilled in the art may readily modify these areas of the boat without departing from the instant inventive concepts.

The primary feature of the boat of this invention is the versatility provided by the convertibility of the rear portion of the boat, from a simple cushioned deck to a rear cabin with a food preparation area, including a sink, and hidden toilet facilities, and with an enclosure providing complete privacy for changing clothes or sleeping, as well as protection against the elements for passengers.

Thus, with the cushioned deck lifted to its elevated orientation 31*b*', the sunken floor area 18 is exposed. Access to this area from the seating area 12 is afforded by the step 17 between the driver's section 13 and the seat 23*c*. A panel 36 extends between the floor 16 and the cushioned deck 31 with its sides supported in slides (not shown) so that the panel may be moved upwardly as shown in dotted lines at 36' in FIG. 5 in the direction of the arrow 37 to remove the panel and provide free access to the rear cabin area 14 when the front section 31*b* of the cushioned deck 31 is elevated to the vertical orientation 31*b*'. An individual may then step down from the floor area 16 to the sunken floor area 18 over the step 17.

Below the forward section 31*b* of the cushioned deck 31 in one corner of the rear cabin area 14, a sink 38, as shown in dotted lines in FIG. 1, may be provided for hand washing and food preparation. A storage area 29 is accessible adjacent to and above the sink 38 through an opening 30 for retrieving stored items such as paper towels, food products, plates and silverware. See FIGS. 3 and 4.

Below the captain's seat 27 is an area forming a storage compartment 39 within which may be located a portable toilet 40. The toilet 40 is accessible through an opening 41 so that an individual in the rear cabin area 14 may reach into the compartment 39 and slide the toilet 40 rearwardly in the direction of the arrow 41 as shown at 40'. See FIGS. 1 and 2. When not in use, the toilet 40 may be slid forwardly into compartment 39 under the captain's seat 27 to remove the toilet from view.

Also located in the storage compartment 39 above a shelf 140, a step 141 may be located to be slid sidewise into the area adjacent the panel 36 to facilitate stepping onto the cushioned deck 31.

Figure 3:
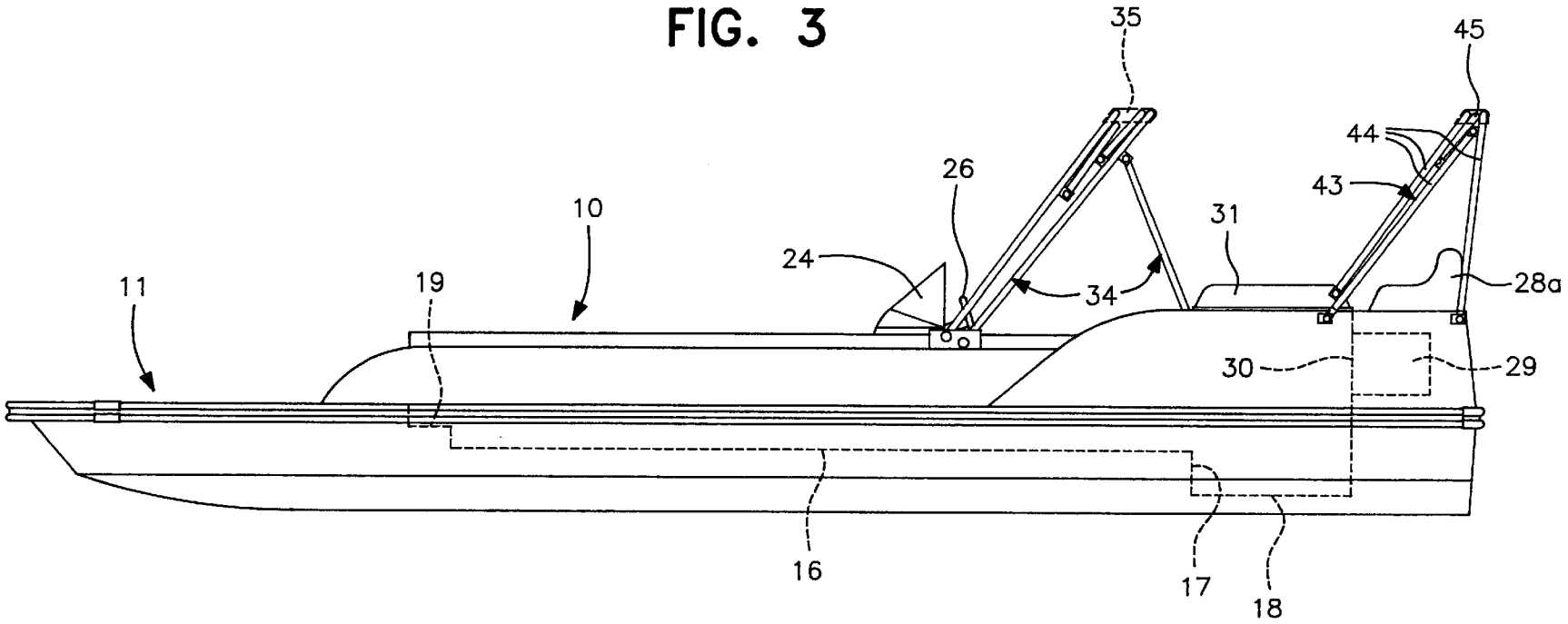
FIG. 3 is a side elevational view of the boat of FIG. 1 showing the cushioned deck in its horizontal orientation and cockpit and cabin canopy supports in retracted position, the floor or deck being shown in dotted lines.
Figure 6:
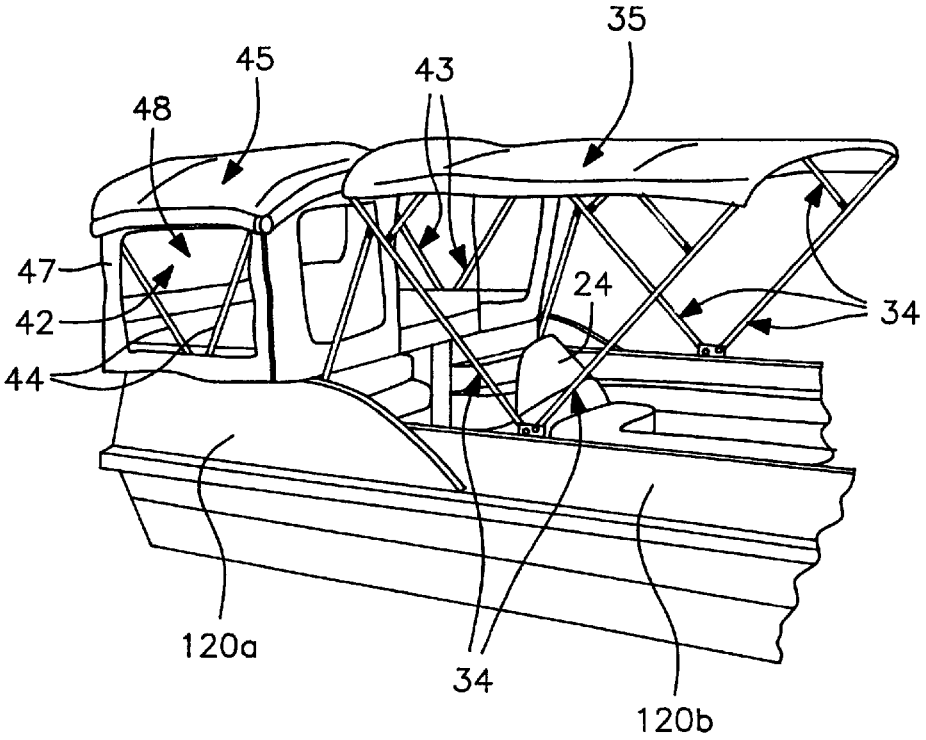
FIG. 6 is a perspective view of the rear portion of the boat of FIG. 1 with the cockpit canopy and the rear cabin area enclosure fully deployed.
Figure 7:
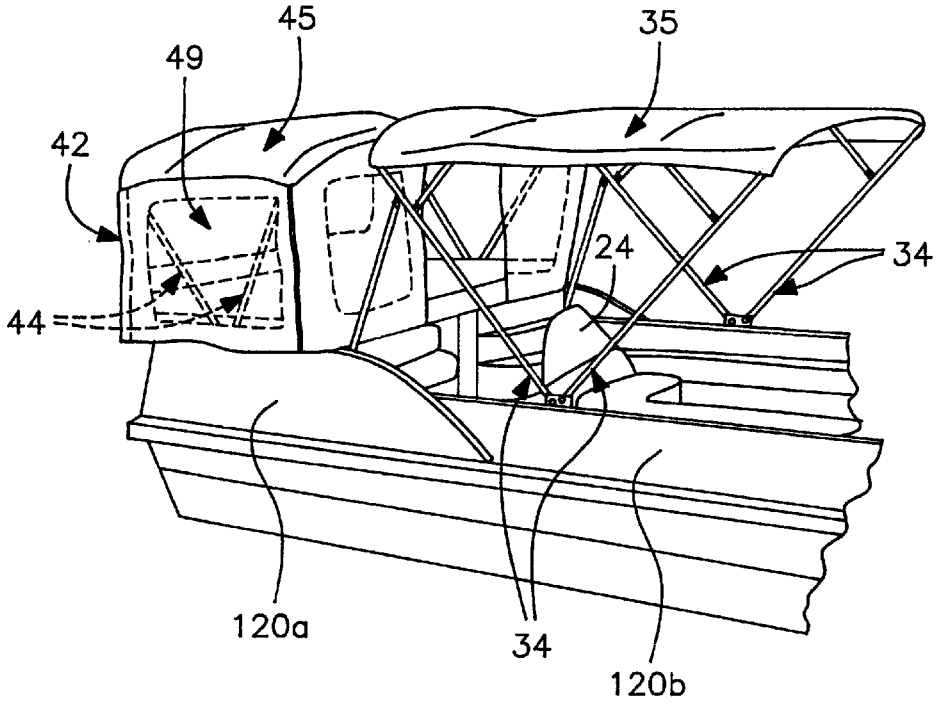
FIG. 7 is a view similar to FIG. 6 illustrating the unrolling of opaque curtains to cover transparent window openings in the rear cabin area enclosure to provide privacy therewithin.

A canopy 35 is supported on a pivoted rod mechanism 34 and can be deployed from its arched or collapsed position shown in FIGS. 3 and 5 to its expanded or open position shown in FIGS. 4, 6 and 7 in a well known manner to cover portions of the cockpit area 12 including the captain's seat 13 and protect the same from sun and rain.

To provide for privacy in the rear cabin area 14 for use of the toilet facilities or for changing clothes, a rear cabin area enclosure may be provided. The enclosure may comprise a frame 43 comprising pivotally mounted rods 44 adapted to carry a canopy 45 over the rear cabin area 14. The support mechanism 43 is shown as folded or collapsed in FIGS. 3 and 5 and fully deployed in FIGS. 4, 6 and 7.

Tie down cables 46 may be used to anchor the support rods of the canopies 35 and 45 in the open or extended position, as necessary.

The overhead canopy 45 is secured to the overhead portions of the support frame for storage as shown in FIGS. 3 and 5. However, with the frame 43 extended to the position shown in FIG. 4, the canopy 45 is stretched out to a horizontally extending position so as to provide cover to the rear cabin area 14.

Figure 10:
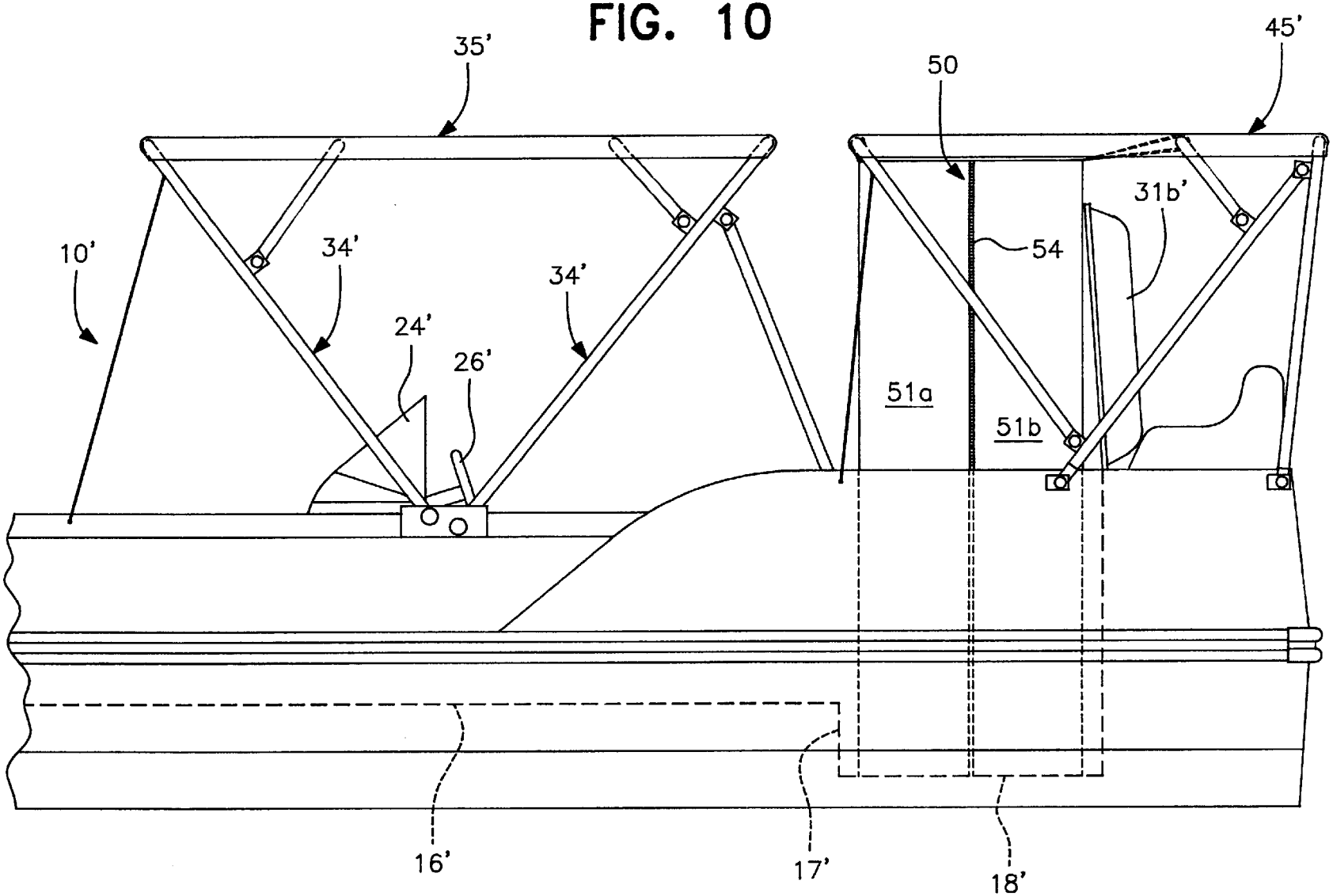
FIG. 10 illustrates the use of a canopy supported privacy curtain in the rear cabin area as an alternate embodiment to the enclosure of FIG. 1.

The canopy frame 43 is conventional and includes a plurality of cross frame bars to support the canopy 45. To provide for privacy, a drop-curtain enclosure 50 (FIG. 10) may be secured to the cross frame bars so as to drop-down over the area behind the captain's seat to thereby enclose the toilet, or to provide a dressing room. Such drop-down curtains are readily available as known to those of ordinary skill in the art, and may include split panels 51*a* and 51*b* on one side with a zipper or VELCRO® closure 54 to enable access to the interior of the enclosed area from the unclosed portion of the rear cabin area 14.

Instead of merely having a private area in the cabin, the invention also contemplates having a fully enclosed cabin area 42 as in the embodiment of FIGS. 1–9, with the raised part 31*b* of the cushioned deck 31 forming the rear wall of the cabin. To this end, as shown in FIG. 6, the enclosure 42 includes a plurality of opaque panels 47, which can extend downwardly from the canopy 46, preferably on the three open sides of the rear cabin area 14, selected ones of which may include screens or transparent window portions 48. Rolled up opaque panels or curtains 49 may be dropped, as shown in FIG. 7, to cover the window portions 48 to provide complete privacy and darkness inside the rear cabin area 14.

Thus, in use, the rear cabin area may be accessed by removing the panel 36 with the forward section 31*b* of the deck 31 in its vertical orientation. If privacy is desired for changing clothes or use of the toilet 40, the enclosure 42 or 50 may be deployed. With the front section 31*b* of the cushioned deck 31 in the horizontal orientation and the enclosure 42 deployed, the curtains 49 may provide privacy and darkness in the rear cabin area for sleeping on the cushioned deck 31.

The foregoing description should be considered as illustrative only of the principles of the invention. Since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed is:

1. In a boat comprising a hull defining a bow and a stern, elongated sides connecting the bow and the stern, and a floor inside the hull, the improvement comprising a rear cabin area adjacent the stern, at least one deck member movable between a generally horizontal orientation in which it conceals said rear cabin area and a generally vertical orientation in which it uncovers said rear cabin area, wherein the floor in said rear cabin area is recessed, further including a movable panel member selectively blocking access to said rear cabin area.

2. A boat as claimed in claim 1, wherein said deck member includes a transversely extending rear edge which is hingedly connected for selective rotation between said horizontal and vertical orientations.

3. A boat as claimed in claim 1, further including an enclosure selectively deployable about at least portions of said rear cabin area to surround and cover said portions.

4. A boat as claimed in claim 3, wherein said enclosure includes a generally horizontally extending canopy providing a roof and generally vertically extending walls providing sides.

5. In a boat comprising a hull defining a bow and a stern, elongated sides connecting the bow and the stern, and a floor inside the hull, the improvement comprising a rear cabin area adjacent the stern, at least one deck member movable between a generally horizontal orientation in which it conceals said rear cabin area and a generally vertical orientation in which it uncovers said rear cabin area, an enclosure selectively deployable about at least portions of said rear cabin area to surround and cover said portions including a generally horizontally extending canopy providing a roof and generally vertically extending walls providing sides, wherein the floor in said rear cabin area is recessed to provide increased height within said enclosure.

6. A boat as claimed in claim 5, wherein said enclosure surrounds only a portion of said rear cabin area, one of said walls including a vertically extending opening providing access to said enclosure from the remainder of said rear cabin area, and means to selectively close said opening.

7. A boat as claimed in claim 6, wherein said enclosure substantially fully surrounds the entire rear cabin area.

8. A boat as claimed in claim 7, wherein said walls primarily comprise an opaque material to provide privacy within said enclosure.

9. A boat as claimed in claim 8, wherein said walls include transparent window portions, and further including opaque curtains to selectively cover said transparent window portions.

10. A boat as claimed in claim 1, further including at least one storage compartment accessible from said rear cabin area when said deck member is in said vertical orientation.

11. A boat as claimed in claim 1, including a cockpit section immediately forward of said rear cabin area, an operator's chair in said cockpit section, a storage compartment beneath said operator's chair, and an opening communicating said operator's chair storage compartment with said rear cabin area.

12. In a boat comprising a hull defining a bow and a stern, elongated sides connecting the bow and the stern, and a floor inside the hull, the improvement comprising a rear cabin area adjacent the stern, at least one deck member movable between a generally horizontal orientation in which it conceals said rear cabin area and a generally vertical orientation in which it uncovers said rear cabin area, further including a cockpit section immediately forward of said rear cabin area, an operator's chair in said cockpit section, a storage compartment beneath said operator's chair, and an opening communicating said operator's chair storage compartment with said rear cabin area, still further including a portable toilet contained within said operator's chair storage compartment, said portable toilet being slidable through said opening into said rear cabin area for use.

13. A boat as claimed in claim 12 wherein the floor in said rear cabin area is recessed and said storage compartment beneath said operator's chair includes a recessed floor, said floor in said rear cabin area and said floor in said storage compartment beneath said operator's chair being at the same level to facilitate sliding said portable toilet through said opening communicating said operator's chair storage compartment with said rear cabin area for use.

14. A boat as claimed in claim 1, further including a sink within said rear cabin area beneath said deck member when said deck member is in said horizontal orientation.

* * * * *